United States Patent [19]

Slesarenko

[11] Patent Number: 4,839,036

[45] Date of Patent: Jun. 13, 1989

[54] VIBRATORY SCREENING MACHINE

[75] Inventor: Vladimir F. Slesarenko, Leningrad, U.S.S.R.

[73] Assignee: Vsesojuzny Nauchno-Issledovatelsky I Proektny Institut Mekhanicheskoi, Leningrad, U.S.S.R.

[21] Appl. No.: 128,275

[22] Filed: Dec. 3, 1987

[30] Foreign Application Priority Data

Dec. 10, 1986 [SU] U.S.S.R. ..... 4158005

[51] Int. Cl.[4] ..... B07B 1/28; B07B 1/54

[52] U.S. Cl. ..... 209/315; 209/365.1; 209/382

[58] Field of Search ..... 209/310, 311, 315, 381, 209/347, 368, 320, 357, 364, 365.3, 346, 382, 323, 348, 349, 365.1; 198/763, 766, 771; 74/26, 110, 470

[56] References Cited

U.S. PATENT DOCUMENTS

| | | | |
|---|---|---|---|
| 1,441,558 | 1/1923 | Buckbee | 209/344 |
| 3,225,926 | 12/1965 | Dostatni | 209/315 |
| 3,633,745 | 1/1972 | Wehner | 209/310 |
| 4,169,788 | 10/1979 | Grunbaum | 209/365.1 |

FOREIGN PATENT DOCUMENTS

| | | | |
|---|---|---|---|
| 1239919 | 12/1967 | Fed. Rep. of Germany . | |
| 573352 | 6/1924 | France | 74/470 |
| 1284602 | 1/1987 | U.S.S.R. | 209/315 |

OTHER PUBLICATIONS

G. Erlenstadt, "Sonic Screening Machines–Advances and Recent Results of the Practice", *Aufbereitungs Technit*, 1977, pp. 333–336.

*Primary Examiner*—Johnny D. Cherry
*Assistant Examiner*—Donald T. Hajec
*Attorney, Agent, or Firm*—Burgess, Ryan & Wayne

[57] ABSTRACT

A vibratory screening machine comprises a frame, at least two screens with meshes of different size arranged in the frame one above the other, pushers hinged to a support in the interscreen space, and vibrating drives for imparting vibrational movements to the pushers. Each pusher is formed by two levers hinged each, at one end to the support, the other end of each lever making contact with one of said screens, and an elastic element being disposed between the levers.

1 Claim, 3 Drawing Sheets

VIBRATORY SCREENING MACHINE

FIELD OF THE INVENTION

The present invention relates to devices for vibrational sizing disperse material by screening, and more particularly to vibratory screening machines in which the screening surface can be directly excited.

The present invention can be most advantageously used in mining, metallurgical, chemical industries, in construction materials industry, and in powder technology.

BACKGROUND OF THE INVENTION

At present, it is multiple-deck screening machines that are most commonly used in practice. In these devices, the sizing of polydisperse materials is carried out by letting them pass through a number of screens with differently sized meshes disposed one beneath the other. One of the parameters controlling the separation process is the amplitude acceleration which is known to depend on the amplitude and frequency of vibrations. For efficient separation of the material using these designs of the screening machines, it is necessary to assign to each screen vibrations with an optimum amplitude acceleration depending on the manufacturing parameters, the most important of them being the separation size.

Known in the art is a vibratory screening machine of WA series manufactured by "Rhewum" of the Federal Republic of Germany (Aufbereitungs-Technik, Nr.7, July 1977, (G.Erlenstadt, "Schallsiebmaschinen-Weiterentwicklung und neue Betriebsergebnisse", p.p.333–336) comprising a frame, screens with meshes of different size arranged within the frame one above the other, pushers formed by impact levers located beneath the screen, each of them being mounted on a supporting shaft and adapted to make contact with the surface of the screen, and electromagnetic vibrating drives. The electromagnetic vibrating drives are coupled each with one supporting shaft for reversible rotation thereof through a given angle. The impact lever secured to the shaft then transmits vibrations of a given amplitude from the vibrating drive to the overlying screen.

A disadvantage of this device is its high cost due to a plurality of expensive electromagnetic vibrating drives, their number increasing with the number of screens in the screening machine.

Known in the art is a vibratory screening machine (DE, C, 1239919) comprising a frame, at least two screens arranged in the frame one above the other, pushers formed by double-arm levers and located in the interscreen space, each of them being rigidly secured to the shaft and adapted to make contact with different screens, and a vibrating drive. The vibrating drive is connected with one of the shafts for reversible rotation thereof through a given angle, while the other shafts are coupled to this shaft and to each other by means of kinematic transmissions. Each push lever has arms of equal length arranged symmetrically about the shaft axis. These pushers transmit synchronous vibrations of a particular amplitude from the vibrating drive to the screens.

In the device mentioned above, the vibrations imparted to the screens have an equal amplitude acceleration defined by the amplitude-frequency characteristic of the vibrating drive. Such screen vibrations fail to provide the required efficiency of screening the material because of different processing conditions the material is subjected to on each individual screen.

SUMMARY OF THE INVENTION

It is the object of the invention to improve the screening effect for polydisperse materials.

With this and other objects in view, there is provided a vibratory screening machine comprising a frame, an upper screen and a lower sieve arranged inside the frame with an interscreen space formed between sieves. Meshes are provided in the sieves, the size of the meshes in the upper sieve exceeding those in the lower sieve. Inside the frame, in the interscreen space, there are provided supports with pushers mounted thereon for transmission of vibrational movements to the sieves. There are vibrating drives that serve to impart vibrational movements to the pushers.

According to the invention, a novel feature of the proposed invention consists in that each pusher is formed by two levers. The ends of the levers are hinged to the support, while the other ends of the levers make contact with different sieves. An elastic element is interposed between said levers.

The provision of the pushers in the form of two levers hinged, at one end to the support, with the other end contacting one of the sieves, as well as an elastic member inserted between the two levers, permit the transmission to the sieve connected with the vibrating drive through said elastic element, of the vibration exhibitng an amplitude and a frequency, and consequently an amplitude acceleration, which differs from that of the other sieve determined by the amplitude/frequency tuning characteristics of the vibrating drive. Experimentlly, by proper selection of the stiffness of the spring, an amplitude accelaration can be assigned to this sieve that is best suited for the specific prosessing parameters of the material screened by this particular screen, thus improving the screening efficiency.

The aforementioned objects and advantages of the proposed invention will be more apparent from the following detailed description of its embodiment with reference to the accompanying drawings.

DESCRIPTION OF THE PREFERRED EMBODIMENT OF THE INVENTION

Figure 1:
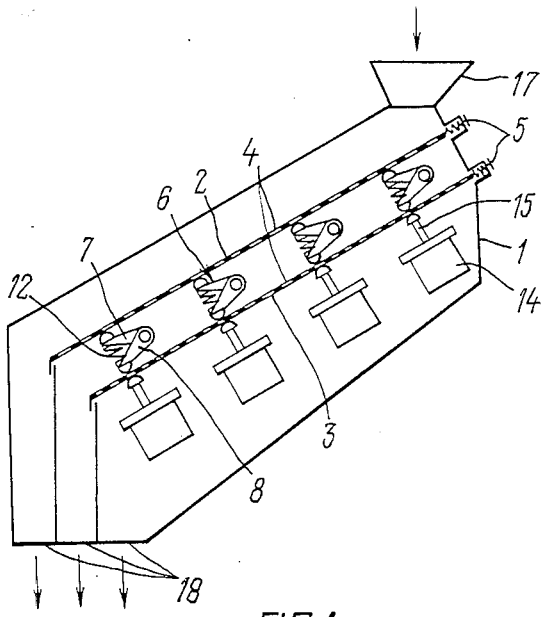
FIG. 1 schematically shows a double-deck vibratory screening machine, according to the invention.
Figure 2:
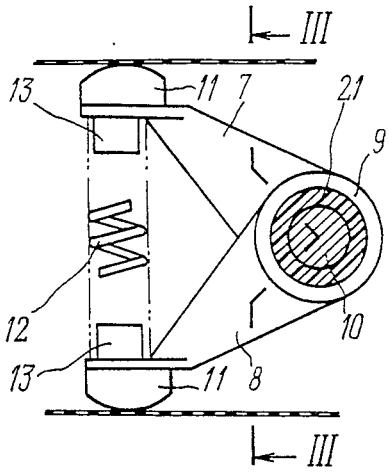
FIG. 2 represents a pusher of the vibratory screening machine.
Figure 3:
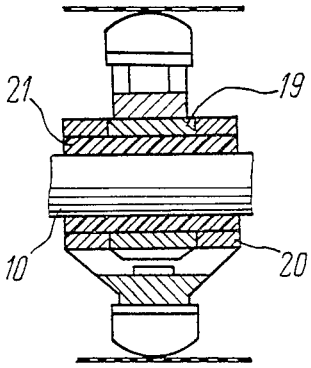
FIG. 3 is a section on the line III—III of FIG.2.

A vibratory screening machine comprises a frame 1 (FIG.1) with an upper sieve 2 and a lower sieve 3 disposed at a slant one above the other. Meshes 4 are provided in the upper sieve 2 and the lower sieve 3, the size of the meshes in the sieve 2 exeeding the size of the meshes in the sieve 3. Both the screens 2 and 3 include tensioning means 5 to give the required prestressing to the sieves 2 and 3. Pushers 6 are disposed between the sieves 2 and 3, formed each by two levers 7 and 8 hinged at one end 9 (FIG.2) to a support 10. At the other end, the levers 7 and 8 make unattached contact, through tips 11, with the sieves 2 and 3, respectively. To extend the operating life of the sieves, the tips 11 are provided with elastomeric coatings.

An elastic element, namely spring 12 is placed between the levers 7 and 8.

An alternative embodiment of the elastic element is, for example, a membrane made of an elastomeric material. From the other side of the tips 11 (FIG.2), on the levers 7 and 8, are provided tongues 13 for securing the spring 12 in a fixed position.

Beneath the lower sieve 3 are located vibrating drives 14 exhibiting particular amplitude/frequency characteristics corresponding to the optimum vibrational characteristics of the sieve 3.

Alternatively, the vibrating drives may be located above the upper sieve 2, interacting, in such a case, with the upper sieve 2.

The vibrating drives 14 employ their rods 15 for interaction through the sieve 3 with the lever 8 of the pusher.

Figure 4:
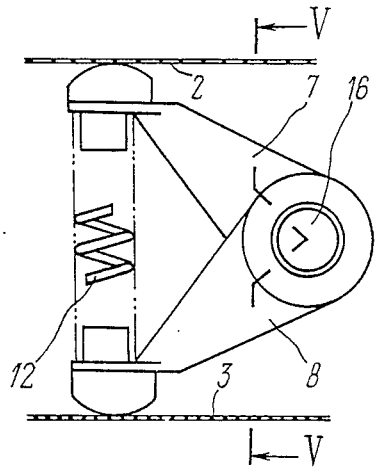
FIG. 4 is another embodiment of the pusher design.
Figure 5:
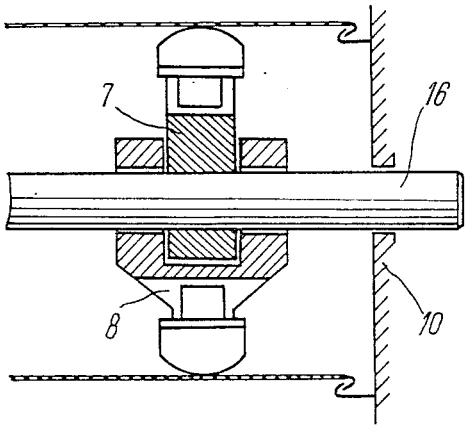
FIG. 5 is a section on the line V—V of FIG. 4.

Other embodiments of coupling the vibrating drives 14 to one of the levers 7 or 8, are also possible such as with one lever 7 (Figs.4,5) rigidly secured to a shaft 16 rotatably mounted in the support 10, and with the other lever 8 loosely fitted on the shaft 16 and coupled through the spring 12 to the first lever 7. The shaft 16 is joined to the vibrating drive 14 (not shown in the drawings, for simplicity) for transmitting reversible movements to the shaft 16.

A loading bin 17 is placed over the top end of the sieve 2, in the frame 1 which is equipped with discharge chutes 18 for discharging below-sieve intermediate, and above-sieve classification products.

For easy replacement of the sieves 2 and 3, in case of assembly and disassembly of the screening machine, a bushing 21 is press-fit between holders 19 and 20 of the levers 7 and 8, respectively, and the support 10, the bushing being made of elastomer to prevent rotation of the levers under gravity, as the sieves are removed. With three of more screens in the screening machine, the pushers are located in all the intersieve spaces.

The screening machine operates as follows.

With the vibrating drives 14 actuated (FIG.1), the rods 15 impart vibrations specified by the amplitude-frequency tuning of the vibrating drive 14 to the sieve 3 and the lever 8 of the pusher 6. These vibrations have such an amplitude and frequency, and hence such an amplitude acceleration, which are optimized for the particular parameters of processing the material screened on the sieve 3. The vibrations of the lever 8 are transmitted through the spring 12 to the lever 7 acting on the sieve 2. In addition to the amplitude and frequency of the vibrating drive, the sieve 2 is then influenced by a further frequency determined by the stiffness of the spring 12, the elastic properties of the screen itself, the mass of the material carried by the seive 2, and the mass-inertia characteristics of the levers 7 and 8. Both the frequencies combine to produce an effect on the sieve 2 with the resulting vibrations imparted thereto which are different from those of the sieve 3.

Thus both the amplitude and the frequency, and hence the amplitude acceleration of vibration of the sieve 2 differ from these parameters of the sieve 3. By a proper preselection of the stiffness of the spring 12, an optimum amplitude acceleration of vibration of the sieve 2 can be provided which would give the most satisfactory screening effect.

The source material is supplied through the loading bin 17 to the sieves 2 and 3 exhibiting an optimum amplitude acceleration, is shifted under vibration down the screens, and classified into three products discharged from the machine through the chutes 18.

What is claimed is:

1. A vibratory screening machine comprising:

a frame;

an upper sieve extending in an upper plane and a lower sieve extending in a lower plane, with meshes provided in said sieves, arranged in said frame so that an intersieve space is formed between said sieves, the size of said meshes in said upper sieve exceeding that of said meshes in the lower sieve;

supports mounted in said frame in said intersieve space;

pushers for transmitting vibrational movements to the sieves primarily in a direction substantially perpendicular to said upper and lower planes, made in the form of two levers having each a first end and a second end, said first ends of said levers being hinged to one of said supports, said second end of each said first lever being unattached to and contacting the upper sieve and the second end of each said second lever being unattached to and contacting the lower sieve, and elastic element means being disposed between said levers for controlling the vibrational movements of one of said sieves, said pushers and said elastic element means being located in the intersieve space;

vibrating drives coupled to said pushers for imparting vibrational movements thereto.

* * * * *